US005658163A

United States Patent [19]

DeRoss

[11] Patent Number: 5,658,163

[45] Date of Patent: Aug. 19, 1997

[54] TERMINAL FOR CONNECTING ELECTRICAL WIRES

[75] Inventor: Robert DeRoss, Palm Harbor, Fla.

[73] Assignee: Molex Incorporated, Lisle, Ill.

[21] Appl. No.: 574,543

[22] Filed: Dec. 19, 1995

[51] Int. Cl.[6] ..... H01R 4/00

[52] U.S. Cl. ..... 439/424; 439/882; 174/84 C

[58] Field of Search ..... 439/882, 881, 439/877, 424; 174/84 R, 84 C

[56] References Cited

U.S. PATENT DOCUMENTS

| | | | |
|---|---|---|---|
| 2,379,567 | 7/1945 | Buchanan | 439/882 |
| 2,753,392 | 7/1956 | Hebeler | 174/84 R |
| 2,873,434 | 2/1959 | Drum et al. | 439/423 |
| 3,077,027 | 2/1963 | Sola et al. | 439/882 |
| 3,412,701 | 11/1968 | Esser | 113/119 |
| 3,728,665 | 4/1973 | Frey | 439/882 |
| 3,892,459 | 7/1975 | Dittman et al. | 339/95 |
| 3,947,082 | 3/1976 | Bender | 339/97 |
| 4,120,556 | 10/1978 | Waldron et al. | 339/142 |
| 4,142,771 | 3/1979 | Barnes et al. | 339/95 |
| 4,932,906 | 6/1990 | Kaley et al. | 439/882 |
| 4,950,838 | 8/1990 | Gordon | 174/94 |
| 5,316,506 | 5/1994 | Ito | 439/879 |
| 5,370,560 | 12/1994 | Ito | 439/877 |

*Primary Examiner*—Neil Abrams
*Assistant Examiner*—T. C. Patel
*Attorney, Agent, or Firm*—Stacey E. Caldwell; James C. Paschall

[57] ABSTRACT

A crimp terminal is adapted for terminating a magnet wire. The terminal includes a wire-receiving barrel defining a longitudinal axis. At least one serration extends axially of the barrel and defines an interior longitudinal edge for piercing the wire coating and engaging the conductor upon crimping the barrel onto the wire. Preferably, a plurality of the axially extending serrations define a plurality of circumferentially spaced longitudinal edges around the interior surface of the barrel. A plurality of axially and circumferentially spaced serrations may be disposed between at least some of the axially extending serrations.

9 Claims, 3 Drawing Sheets

TERMINAL FOR CONNECTING ELECTRICAL WIRES

FIELD OF THE INVENTION

This invention generally relates to the art of electrical connectors and, particularly, to a terminal, such as a crimp terminal, for connecting electrical wires and, in particular, for connecting magnet wires.

BACKGROUND OF THE INVENTION

Electrical terminals are used in a wide variety of applications for connecting and/or terminating insulated electrical wires. An insulated electrical wire typically includes a center conductor (which may be solid or stranded) surrounded by an outer sheath or cover of insulating material such as plastic. With some terminals for insulated wires, the insulating covering is removed to expose the center conductor, and at least portions of the terminal are crimped onto the exposed conductor to establish an electrical connection therewith, while other portions of the terminal may be clamped onto the outer insulating covering to provide a type of strain relief for the wire. This type of terminal most often is used to terminate the very end or tip of an insulated electrical wire. It can be understood that a separate fabricating step is required to remove the insulating covering and expose the center conductor.

In order to eliminate the step of insulation removal, insulation displacement terminals (IDT) or insulation piercing terminals have been designed. As is well known, these types of terminals include portions which cut through or pierce the outer insulating covering of the insulated electrical wire to establish an electrical connection with the center conductor. One type of insulation displacement terminal includes a transverse wall having a slot into which the insulated wire is forced. The edges of the slot cut through the insulation of the wire. Other insulation displacement terminals have pointed prongs, discrete serrations, detents, or the like which are forced through the insulating covering of the wire, such as during a crimping operation which also performs a secondary function of providing strain relief for the wire. These types of insulation displacement terminals most often are used in connecting or terminating insulated electrical wires wherein the outer insulating covering of the wires is relatively soft and easy to penetrate or cut.

On the other hand, a type of insulated electrical wire commonly called a "magnet wire" is used in a variety of applications which include wire windings, such as motors, generators and transformers. Instead of using a typical insulated wire which has a relatively soft plastic outer insulating covering, the insulation of a magnet wire is a layer of lacquer, varnish or epoxy. The resulting insulating coating is thin and relatively hard. Typical insulation displacement prongs, detents or the like simply are not sufficiently robust to cut through or pierce this hard coating of magnet wires.

One approach to terminating magnet wires or other electrical wires having relatively hard outer coatings is simply to provide a very heavy or thick terminal which literally is "crushed" (versus being crimped) onto the wire to literally smash through the hard coating. Such relatively massive terminals not only involve excessive materials, but their fabrication is more expensive and problems can occur in damaging the terminated wires, themselves, because of the relatively large forces required to crush the sizable terminal.

The present invention is directed to a much simpler and inexpensive terminal, particularly a crimp terminal, which is effective for piercing the hard coating of magnet wires and making electrical contact with the conductor of the wire.

SUMMARY OF THE INVENTION

An object, therefore, of the invention is to provide a wire connector for connecting an electrical wire having an insulating or non-conductive coating.

In the exemplary embodiment of the invention, the connector is a crimp terminal for terminating a magnet wire. The terminal includes a wire-receiving barrel defining a longitudinal axis. At least one serration extends axially of the barrel and defines an interior longitudinal edge for piercing the coating of the electrical wire and engaging the conductor upon crimping the barrel onto the wire. Preferably, a plurality of the axially extending serrations are provided to define a plurality of circumferentially spaced longitudinal edges around the interior surface of the barrel.

The axially extending serrations provide enhanced axial surface contact with the center conductor of the coated wire. This enhances the quality of the connection between the conductor and the crimp barrel. The axial serrations also prevent the wire from rotating about its longitudinal axis as the barrel is crimped.

In the preferred embodiment of the invention, the wire-receiving barrel is generally cylindrical. The barrel is open-ended for passing therethrough of the insulated electrical wire. The longitudinal edges of the axially extending serrations project inwardly of an interior cylindrical surface of the barrel along a substantial length of the barrel.

Lastly, another feature of the invention contemplates the provision of a plurality of axially and circumferentially spaced serrations disposed between the axially extending serrations. The axially and circumferentially spaced serrations have circumferentially extending edges for piercing the coating of the electrical wire.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
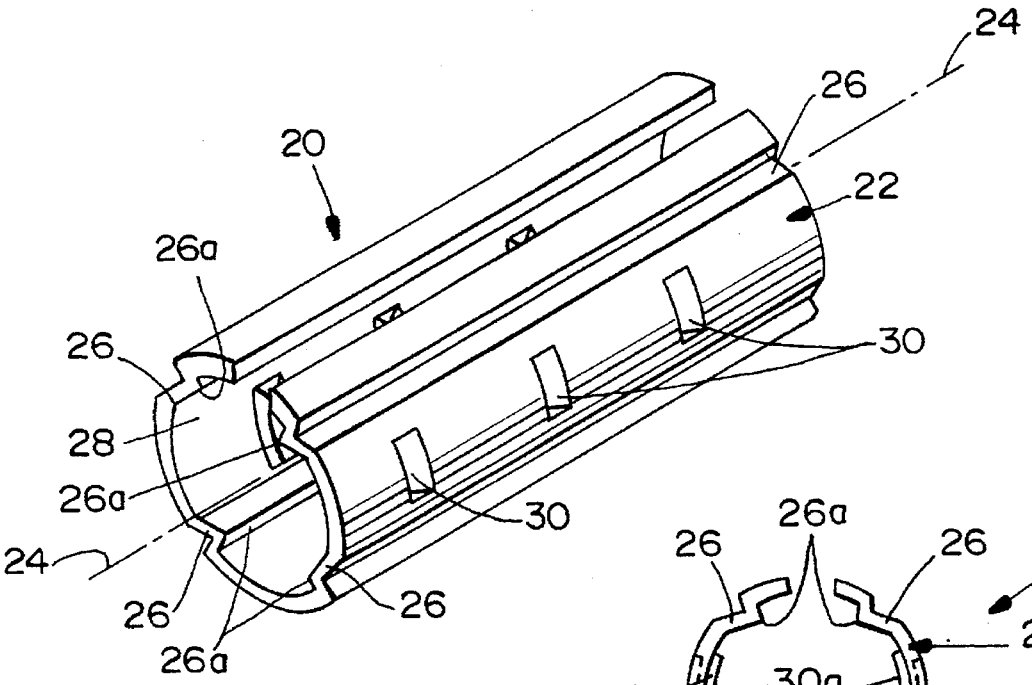
FIG. 1 is a perspective view of a crimp terminal embodying the concepts of the invention.
Figure 2:
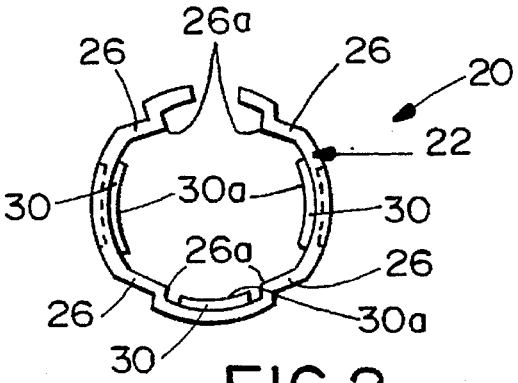
FIG. 2 is an end elevational view of the crimp terminal of FIG. 1.

Referring to the drawings in greater detail, and first to FIGS. 1 and 2, the invention is embodied in a wire connector in the form of a crimp terminal, generally designated 20, for terminating at least one insulated electrical wire. The crimp terminal includes a generally cylindrical, open-ended wire-receiving barrel, generally designated 22, defining a longitudinal axis 24. The barrel is stamped and formed of sheet metal material. As will be seen hereinafter, the barrel is adapted for crimping or clamping onto at least one coated electrical wire.

The invention contemplates providing wire-receiving barrel 22 with at least one serration 26 extending axially of the barrel and defining an interior longitudinal edge 26*a* for piercing the coating of the electrical wire and engaging the central conductor upon crimping the barrel onto the wire. Preferably, a plurality of the axially extending serrations 26 are stamped longitudinally of barrel 22 to define a plurality of circumferentially spaced, longitudinally extending edges 26*a* around the interior surface 28 of the barrel.

The invention also contemplates that a plurality of axially and circumferentially spaced serrations 30 may be disposed between axially extending serrations 26. The axially and circumferentially spaced serrations 30 define circumferentially extending edges 30*a* also for piercing the coating and engaging the conductors of the electrical wire or wires.

Figure 3:
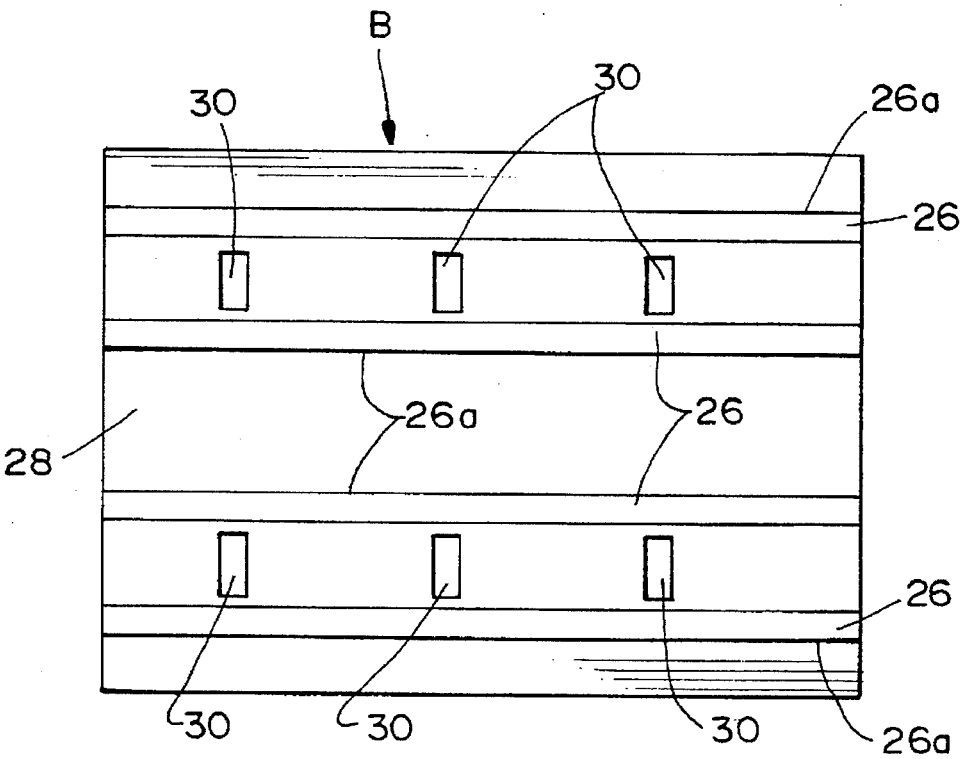
FIG. 3 is a plan view of a stamped blank from which the terminal of FIG. 1 is formed.

FIG. 3 shows a blank, generally designated "B", from which crimp terminal 20 is formed. Actually, blank "B" shows the interior surface 28 of crimp barrel 22 whereby longitudinal edges 26*a* of axially extending serrations 26 and circumferentially extending edges 30*a* of serrations 30 clearly can be seen. The blank is formed in a singular stamping step between a pair of dies to form or skive both the axially extending serrations 26 and the axially and circumferentially spaced serrations 30. After stamping, the blank simply is rolled to form the cylindrical wire-receiving barrel 22 shown in FIGS. 1 and 2.

Figure 4:
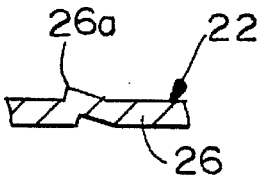
FIG. 4 is a radial section through one of the axially extending serrations of the crimp terminal of FIG. 1.
Figure 5:
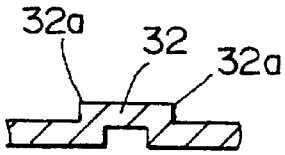
FIG. 5 is a view similar to that of FIG. 4, but showing a different cross-sectional configuration for the axially extending serrations.
Figure 6:
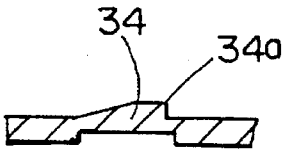
FIG. 6 is a view similar to that of FIGS. 4 and 5, but showing still another cross-sectional configuration of the axially extending serrations.

FIG. 4 shows a section through one of the axially extending serrations 26 to clearly show that longitudinally extending edges 26*a* are quite sharp. FIG. 5 shows an alternate embodiment of a stamped serration 32 which is generally rectangular in configuration to define a pair of sharp edges 32*a* for piercing the coating and engaging the conductor of the electrical wire. FIG. 6 shows a hybrid rectangular/triangular serration 34 which still forms a relatively sharp edge 34*a* for cutting into the coating and engaging the conductor of the insulated electrical wire.

Figure 7:
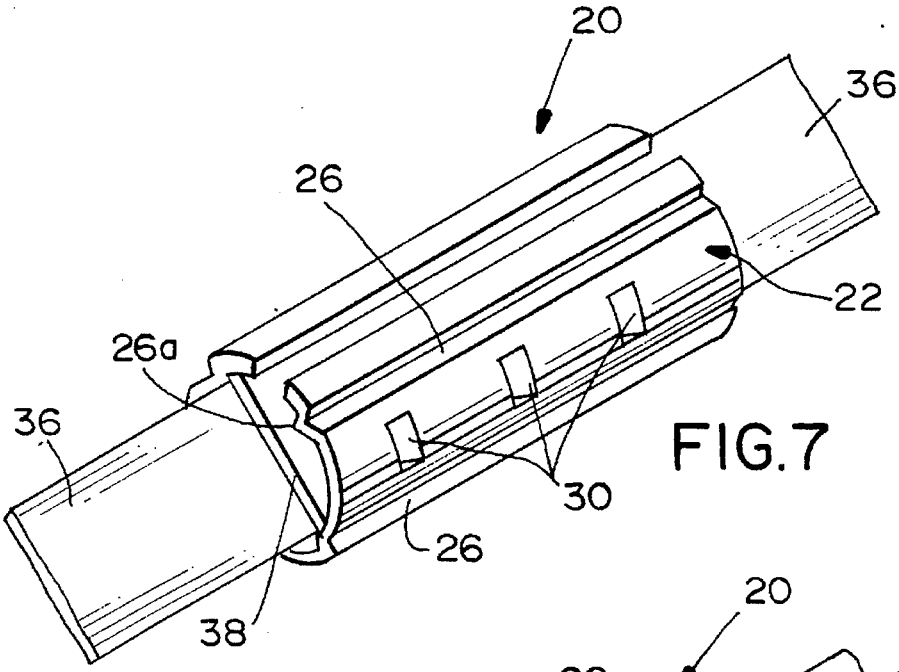
FIG. 7 is a perspective view showing the terminal of FIG. 1 positioned about a pair of overlapping magnet wires.

FIG. 7 shows crimp terminal 20 with barrel 22 receiving a pair of magnet wires 36. The wires overlap each other at the distal ends thereof, as at 38, so that ends of the wires extend the full length of barrel 22. The wires are typical magnet wires in that they are flat in configuration. Although not visible in FIG. 7, the wires have a flat conductive core, such as of copper, coated with a thin and relatively hard layer of insulating material, such as lacquer, varnish or epoxy. Sharp longitudinal edges 26*a* of axially extending serrations 26, along with circumferentially extending edges 30*a* of axially and circumferentially spaced serrations 30, are designed for piercing through the thin hard layer which coats the flat magnet wires and for engaging the conductive core.

Figure 8:
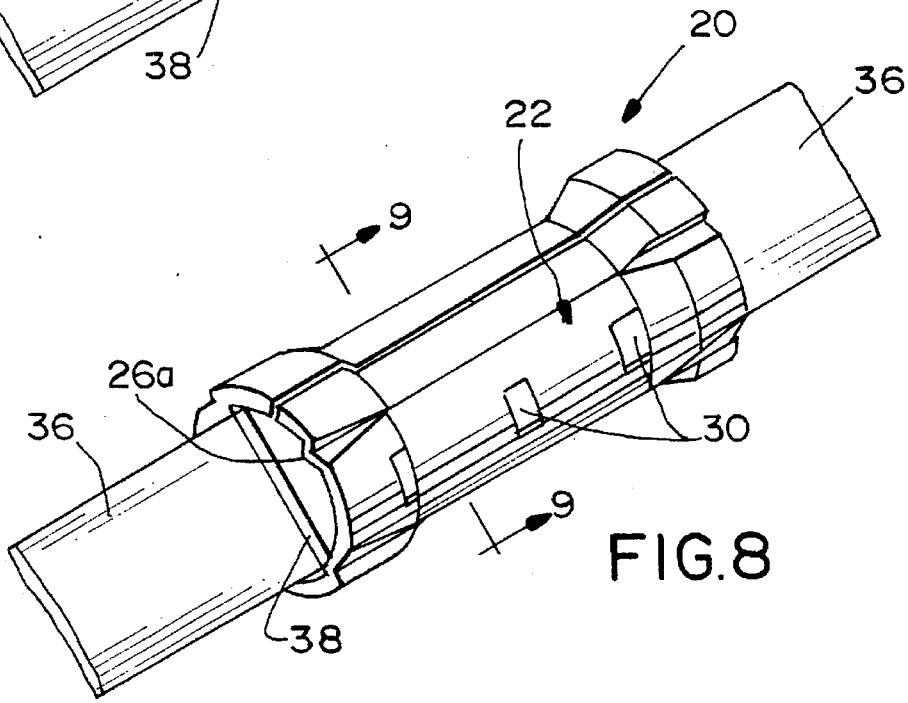
FIG. 8 is a view similar to that of FIG. 7, but showing the terminal crimped onto the wires.
Figure 9:
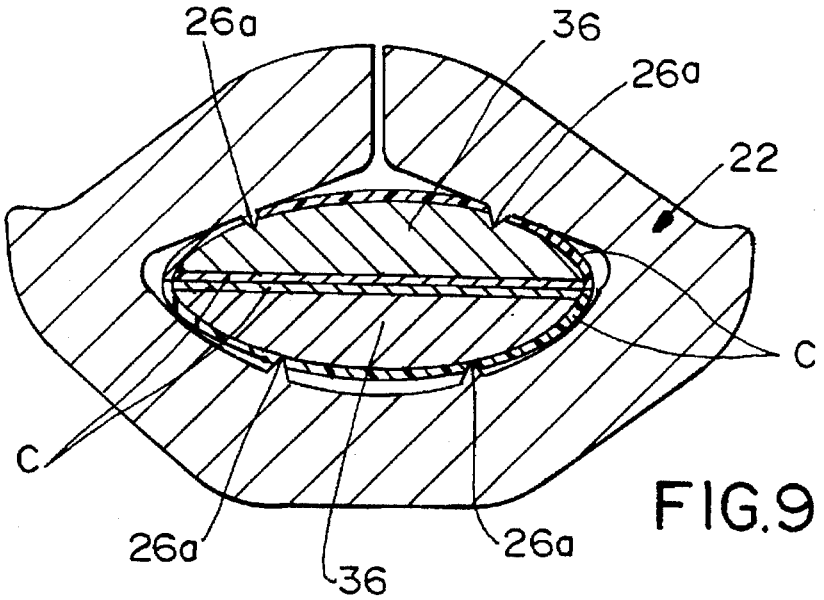
FIG. 9 is an enlarged section taken generally along line 9—9 of FIG. 8.

FIGS. 8 and 9 show wire-receiving barrel 22 of crimp terminal 20 having been crimped onto the overlapped magnet wires 36. It can be seen in FIG. 9 that longitudinal edges 26*a* of the axially extending serrations have pierced through the insulating coating "C" of the magnet wires to establish an electrical connection with the interior conductive cores of the wires. As stated above, the axial serrations provide enhanced axial surface contact with the wire conductors and, thus, enhance the quality of the connection between the conductors and crimp barrel 22. The axial serrations also will prevent the wires from rotating about the longitudinal axis as the barrel is crimped.

Figure 10:
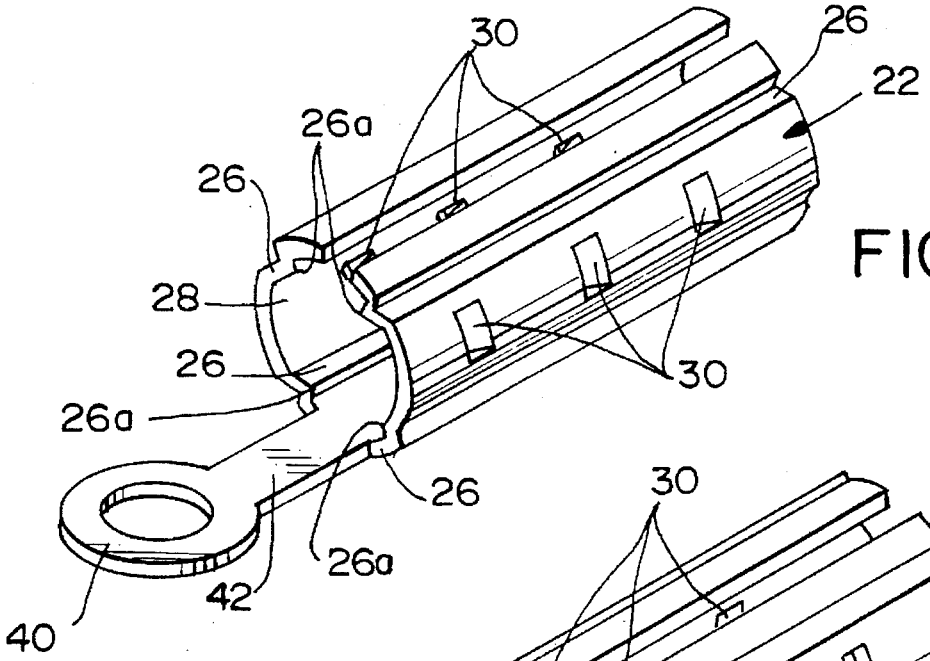
FIG. 10 is a perspective view of another embodiment of a crimp terminal embodying the concepts of the invention.

FIG. 10 shows an alternate embodiment of the invention wherein the crimp terminal is provided with a ring 40 connected by a strap 42 to wire-receiving barrel 22. Otherwise, the barrel, along with axially extending serrations 26, as well as axially and circumferentially spaced serrations 30, are the same as described above in relation to FIGS. 1–4 and 7–9. Consequently, like numerals have been applied to designate like components as described n relation to terminal 20, above. The ring is just one type of connecting means with which barrel 22 can be used.

Figure 11:
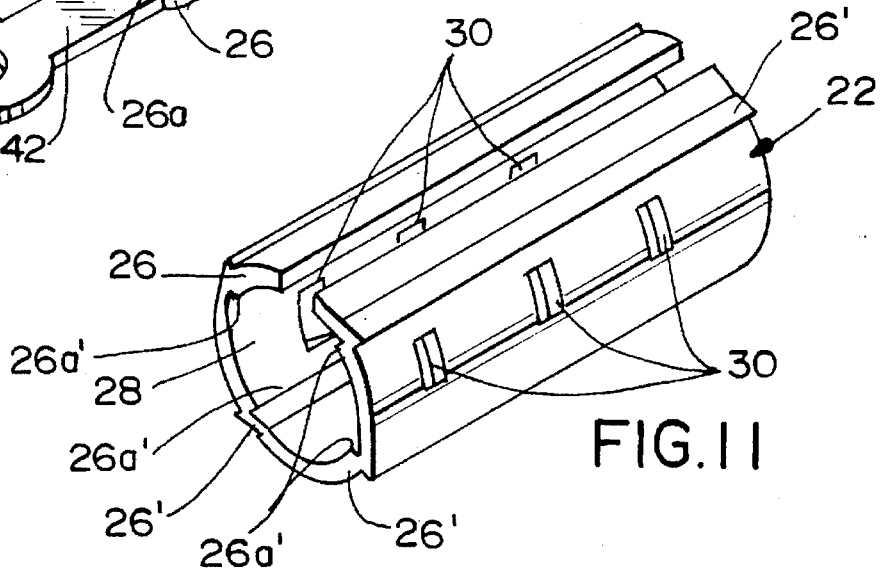
FIG. 11 is a further embodiment of a crimp terminal embodying the concepts of the invention.

Lastly, FIG. 11 shows a further embodiment of the invention wherein axially extending serrations 26' have been formed in a stamping operation opposite the direction of axially extending serrations 26 shown in FIGS. 1 and 2. Nevertheless, longitudinally extending sharp edges 26*a*' still are formed projecting inwardly of the interior surface 28 of wire-receiving barrel 22 in FIG. 11 for purposes of piercing the coating and engaging the conductor of an electrical wire or wires, such as magnet wires 36, upon crimping the barrel onto the wires.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A crimp terminal for terminating at least one coated electrical wire, comprising:

a plurality of circumferential wall segments providing a wire-receiving barrel, each one of said circumferential wall segments converging with an adjacent one of said wall segments to define defining a longitudinal axis, and a pair of adjacent ones of said plurality of circumferential wall segments defining at least one serration extending axially along a substantial length of the barrel and defining an interior longitudinal edge projecting inwardly of an interior surface of the wire-receiving barrel along the length of the serration for the primary purpose of piercing the coating of the electrical wire and engaging an inner conductor upon crimping the barrel onto the wire.

2. The crimp terminal of claim 1 wherein said wire-receiving barrel is generally cylindrical.

3. The crimp terminal of claim 1 wherein said wire-receiving barrel is open-ended for the coated electrical wire to pass therethrough.

4. The crimp terminal of claim 1, including a plurality of said axially extending serrations extending along a substantial length of the barrel defining a plurality of circumferentially spaced longitudinal edges therealong around the interior surface of the barrel.

5. The crimp terminal of claim 4, including a plurality of axially and circumferentially spaced serrations disposed between at least some of said axially extending serrations and having circumferentially extending edges formed thereon for piercing the coating and engaging the conductor of the electrical wire.

6. A wire connector for connecting magnet wire having a conductor and a non-conductive coating, comprising:

a generally cylindrical barrel including a plurality of circumferential wall segments defining a longitudinal axis, each of said plurality of circumferential wall segments converging with an adjacent one of said wall segments, and at least one serration extending axially of the barrel on the interior thereof and along a substantial length thereof said serration comprising pair of adjacent one of said circumferential wall segments defining an interior longitudinal edge projecting inwardly of an interior surface of the barrel along the length of the serration for the primary purpose of piercing the non-conductive coating and engaging the conductor of the magnet wire.

7. The wire connector of claim 6, including a plurality of said axially extending serrations extending along a substantial length of the barrel and defining a plurality of circumferentially spaced longitudinal edges therealong around the interior surface of the barrel.

8. The wire connector of claim 7, including a plurality of axially and circumferentially spaced serrations disposed between at least some of said axially extending serrations and having circumferentially extending edges for piercing the non-conductive coating and engaging the conductor of the magnet wire.

9. The wire connector of claim 6 wherein said wire-receiving barrel is open-ended and receives the magnet wire therethrough.

* * * * *